United States Patent [19]

Alder

[11] 4,357,226

[45] Nov. 2, 1982

[54] ANODE OF DIMENSIONALLY STABLE OXIDE-CERAMIC INDIVIDUAL ELEMENTS

[75] Inventor: Hanspeter Alder, Flurlingen, Switzerland

[73] Assignee: Swiss Aluminium Ltd., Chippis, Switzerland

[21] Appl. No.: 215,938

[22] Filed: Dec. 12, 1980

[30] Foreign Application Priority Data

Dec. 18, 1979 [CH] Switzerland ..... 11198/79
Feb. 4, 1980 [DE] Fed. Rep. of Germany ..... 3003922

[51] Int. Cl.[3] ..... C25C 3/12; C25C 7/02

[52] U.S. Cl. ..... 204/286; 204/67; 204/243 R

[58] Field of Search ..... 204/67, 243 R, 244–247, 204/286

[56] References Cited

U.S. PATENT DOCUMENTS 3,960,678 6/1976 Alder ..... 204/67
4,039,401 8/1977 Yamada et al. ..... 204/67
4,269,673 5/1981 Clark ..... 204/67

*Primary Examiner*—F. Edmundson
*Attorney, Agent, or Firm*—Bachman and LaPointe

[57] ABSTRACT

The invention relates to an anode of a fusion electrolysis furnace for the production of aluminum, which anode consists of a plurality of individual oxide-ceramic elements of stable dimensions. The individual elements have linear cross-sectional dimensions of 2–12 cm. on the current exit surface. These elements have a length which corresponds to 2–20 times the value of the mean linear cross-sectional dimension, they are arranged approximately parallel with a mean distance between outer surfaces of 1–20 mm. and are held together mechanically stably at the end facing the current entry with an electrically conductive device situated outside the molten electrolyte. The anode in bundle configuration, in comparison with oxide-ceramic anodes of large format, has a lower corrosion erosion, is simpler to produce ceramically and has a greater stability to temperature changes.

16 Claims, 1 Drawing Figure

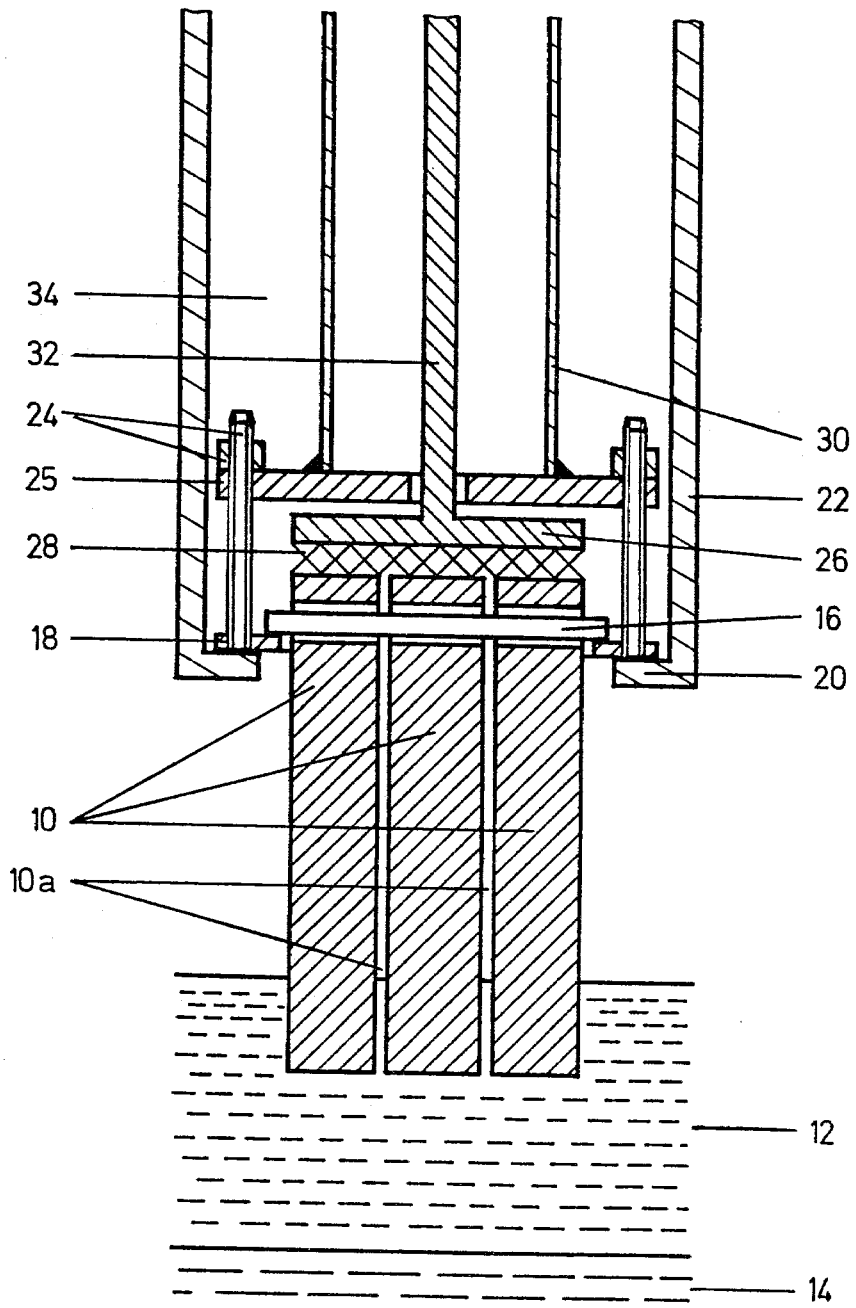
34
32
24
25
28
18
10
10a
30
22
26
16
20
12
14

ANODE OF DIMENSIONALLY STABLE OXIDE-CERAMIC INDIVIDUAL ELEMENTS

BACKGROUND OF THE INVENTION

The present invention relates to an anode of a fusion electrolysis furnace for the production of aluminum, which anode consists of a plurality of individual oxide-ceramic elements of stable dimensions.

The currently used Hall-Héroult process for obtaining aluminum for alumina dissolved in cryolite takes place at 940°–1000° C., and electrolysis is carried out between a horizontal anode and a parallel liquid aluminum cathode. The anodically precipitated oxygen reacts with the anode carbon to form carbon dioxide and the carbon burns away. At the same rate as the linear burning away of the anode takes place, in the case of suitable cell geometry the build-up of the aluminum layer takes place cathodically, so that the interpolar distance is maintained. After the scooping of the liquid aluminum the interpolar distance must be freshly adjusted by lowering of the anodes. Furthermore, burned-away carbon anode blocks must be replaced at regular intervals. A special works, the anode factory, is necessary for the production of these anode blocks.

Replacement of the burning carbon anodes by an oxide-ceramic anode of stable dimensions should, in comparison with the conventional Hall-Héroult process, bring a whole series of advantages:

- Simplification of furnace operation;
- Reduction and improved detection of the furnace waste gases;
- Independence of the fluctuations of price and quality of the petroleum coke; and
- Lower overall energy consumption of the process.

These factors should take effect in reduced metal production costs.

Oxide-ceramic anodes of stable dimensions which are used in cryolite melts are known and are disclosed for example in Ger.Pub.Sp. 24 25 136. In further publications whole classes of substances for use as oxide-ceramic anodes are described, for example spinel structures in Ger.Pub.Sp. 24 46 314 and Jap. publication specification 52-140 411 (1977). In Jap. publication specification 52-153 816 (1977) finally an oxide mixture of the composition $Zn_{1.7}Ni_{0.3}SnO_4$ is proposed which is applied to a wire mesh, whereby a gas-permeable porous electrode is formed.

The multiplicity of proposed metal oxide systems indicates that hitherto it has not been possible to find an ideal material which satisifies the many, in some cases contradictory, demands of cryolite electrolysis, and which is economical.

In the replacement of the currently utilized carbon blocks of large format of the Hall-Héroult electrolytic cell by ceramic anodes of stable dimensions and of good conductivity, three main difficulties arise:

- The production of ceramic bodies of large format;
- The insertion and manner of operation in the electrolytic cell without mechanical damage to the ceramic bodies; and
- The achievement of long life with minimum possible anode corrosion.

Replacement of the carbon anodes by ceramic anodes signifies that several tons of ceramic material must be mixed, ground, pressed and sintered. The resultant anode bodies should differ as little as possible in their physical properties. In Ger.Pub.Sp. 24 25 136 it was therefore proposed to embed individually produced anode blocks of oxide-ceramic material in an electrically insulating carrier plate resistant to the melt. The individual anode blocks are in contact with a current-distributor plate. The ceramic anodes can be inserted into the carrier plate in such a way that they are flush with the lower plane of the carrier plate or protrude from it. The removal of the generated anode gas is facilitated in that individual apertures in the carrier plate are not fitted with anode blocks (FIGS. 5 and 6).

The Figures also show that the anodes are designed so that both the carrier plate and the oxide-ceramic material are dipped into the melt.

In the insertion of the anodes into the melt and in the case of temperature fluctuations in operation, axial and radial temperature gradients occur which cause mechanical tensile stresses which can even lead to tearing of the carrier plate fitted with oxide-ceramic blocks.

The erosion of the ceramic metal oxide is effected substantially by the aluminum present in the cryolite. Thus, the anode corrosion is dependent upon the conveying of substance from the melt to the solid body, which is mainly a function of the escape of the anodically generated gas. The desired gas outflow is only partially achieved by the arrangement of regularly distributed holes in the carrier plate according to Ger. Pub. Sp. 24 25 136, especially with ceramic anodes protruding from the electrically insulating carrier plate.

SUMMARY OF THE INVENTION

The inventors have therefore faced the problem of producing an anode of large format consisting of individual oxide-ceramic elements of stable dimensions, which leads to satisfactory metal production with long life, good stability to temperature changes and minimum erosion.

In accordance with the invention the problem is solved by the provision of individual elements having linear cross-sectional dimensions of 2–12 cm. on the current exit surface and having a length which corresponds to 2–20 times the value of the mean linear cross-sectional dimension. The elements are arranged approximately parallel with a mean distance between the outer surfaces of 1–20 mm., and are mechanically stably held together at the end facing the current entry with an electrically conductive device situated outside the molten electrolyte.

BRIEF DESCRIPTION OF THE DRAWING

The drawing diagrammatically illustrates the present invention and shows a vertical section through an anode bundle immersed in molten electrolyte.

DETAILED DESCRIPTION

Although the individual oxide-ceramic elements are preferably made cylindrical or prismatic, especially with hexagonal, square or rectangular cross-section, they can also be made as cone frusta or as pyramid frusta, in which case however the narrowing in the direction of the electric current should be only slight.

In principle the individual elements can have any desired geometric form, if their linear cross-sectional dimensions, their ratio of length to mean linear cross-sectional dimension and the mean distance between their outer surfaces lie in the range of the prescribed values.

The linear cross-sectional dimensions on the current exit surface of the oxide-ceramic individual elements lie preferably between 3 and 10 cm. The length of the individual elements advantageously corresponds to 3–10 times the value of the mean linear cross-sectional dimension. The mean distance between adjacent individual elements preferably lies in the range of 2–5 millimeters.

The geometric form and the cross-section of the oxide-ceramic individual elements can be made equal or equally can be made different. Especially in the case of individual elements with round cross-section, still further elements of substantially smaller cross-sectional dimension can be arranged in the relatively large cavities.

Edges or corners of the oxide-ceramic individual elements can be left, rounded off or chamfered.

The geometric cross-sectional form of the entire bundle is preferably rectangular or square, and individual or several separate elements on the corners can be omitted.

A superficial dimension for the stability to temperature change of the oxide-ceramic material is the ratio of thermal expansion ($\alpha$) to the coefficient of thermal conductivity (k) at the corresponding temperature.

For two ceramic materials having greatly different stability to temperature change, the ratio of ($\alpha$/k) at 900° C. can be calculated as follows:

| | $SnO_2$ | $Fe_2O_3$ |
|---|---|---|
| Thermal expansion$\alpha$: ($10^{-6} \cdot {}^\circ K.^{-1}$) | 4.5 | 14 |
| Thermal conductivity k: (W/m · °K.) | 7.6 | 3.5 |
| Quotient: ($\alpha$/k) | 0.6 | 4.0 |

For a given temperature on the outer surface of an oxide-ceramic individual element thus the stressing occurring in the interior is substantially variable:

For haematite it is for example 6.7 times greater than for tin oxide. If now the thermal tensile stressing exceeds the local bending strength, then the ceramic body splits.

There are restrictions on the sizes in which anode bodies of oxide-ceramic materials can be produced because the bending strength cannot be increased at will. It is therefore preferred, especially in the case of larger individual oxide-ceramic elements, to form a cavity closed against the molten electrolyte. The individual oxide-ceramic elements are formed and fitted so that they can yield freely to the thermal tensile stressing, for example in that the current supply conductor is merely pressed against the upper edge of the anode.

However the edge thickness of the elements cannot be reduced at will, with regard to the bending strength, because otherwise the voltage drop for the anodic current issuing at the exit surface with a current intensity of 0.1–3.0 A/sq.cm. would have too great a value.

The material used for the production of the individual oxide-ceramic elements consists for 90% or more by weight of at least one oxide of the metals Cr, Mo, W, Mn, Fe, Co, Ni, Zn, Sn, Pb. To these oxides or oxide mixtures, called basic material, there are added less than 10% by weight of at least one oxide of the following metals: Rare earths, Ti, Zr, Hf, V, Nb, Ta, Mg, Ca, Sr, Ba, Al, Ga, Si, Ge, Cu, As, Sb, Bi.

The individual oxide-ceramic elements are produced according to known methods of ceramic technology.

The invention will be explained in greater detail with reference to the drawing. The single FIGURE shows diagrammatically a vertical section through a bundle anode dipped into the molten electrolyte.

The prismatic anode rods 10 with square cross-section of oxide-ceramic material with electronic conductivity have a diameter of 8 cm. and a length of 40 cm. The edges at the ends are chamfered.

A plurality of anode rods is assembled into a bundle with three outer elements, the mean distance 10*a* between the circumferential surfaces of adjacent anode rods amounting to 3 mm. This distance serves on the one hand for drawing off the anode gas and on the other so that the thermal expansion of the rods can be taken up flexibly.

On their undersides the anode rods dip into the molten electrolyte 12 which lies on the liquid metal 14 forming the cathode. The crust formed from solidified electrolyte material and the alumina tipped on to the crust are not illustrated, for the sake of simplicity.

The anode rods are drilled through a few centimeters below the upper end face and penetrated by a suspension rod 16 of corresponding diameter consisting of highly refractory steel. The two ends of the rod protruding from the outer anodes are mounted on carrier plates 18 which in turn are mounted on horizontal inward flanges 20 of an outer tube 22. This outer tube 22, formed in conformity with the bundle of anode rods, is secured through electric insulators to the furnace lid or anode carrier (not shown).

The carrier plate 18 is adjusted by bolts or screws 24 on the bottom plate 25 of the inner tube 30.

The electrical contact between the presser plate 26 and the flat-ground upper end face of the anode rods 10 is produced either mechanically, by pressing with 0.05–1.0 MPa pressure alone or in combination with an intermediate layer 28 of good electrical conductivity. This intermediate layer 28 consists of one or more layers of metal wire mesh, preferably nickel wire mesh, which is used either untreated or oxidized in the flame after thermal treatment. In place of a metal wire mesh or preferably together therewith a composition consisting of metal particles and low-sintering ceramics, known as a Cermet, is used whereby the metal-oxide-ceramic current transmission is facilitated.

In order to maintain the most favorable application pressure upon the anode rods 10, the presser plate 26 of the current supply conductor 32 can be pressed on by a suitable device, for example a spring. The current supply conductor 32 is situated in the interior tube 30 of the anode mounting (not shown) which is used as counterpiece for the presser device. The bottom plate 25 of the inner tube 30, through the central bore of which the current supply conductor 32 is conducted freely and which is connected by means of threaded bolts 24 with the carrier plate, here serves on the one hand for the positioning of the anode rods 10 and on the other as basis for the application pressure.

The cavity 34 between inner and ouer tubes is sealed off, for example by an alumina filling, to prevent the escape of the anode gases.

It is self-evident that the anode rods can also be suspended in a manner differing from that shown in the drawing. Thus the upper region of the anodes can be drilled through cross-wise at different levels, whereupon the suspension rods consisting of highly refractory steel can be drawin in at right angles to one another. Likewise a notching preferably of semi-circular cross-section can be formed laterally of the anodes and the securing rods can be pushed in.

The production of the individual oxide-ceramic elements 10 for the anode according to the invention and their use in a fusion electrolytic furnace for the production of aluminum are to be explained in greater detail by reference to the following examples.

Example 1

40 kg of spray-roasted iron oxide ($Fe_2O_3$, haematite) with a purity of about 99.6% and a mean particle size of approximately 40 microns are mixed with 1.05 kg. of titanium dioxide and precalcined at 1020° C. Then the powder is comminuted in a ball mill during 125 hours to a mean grain of 2.5 microns. The material is charged into a latex rubber mould of parallelepipedic form and put into the pressure chamber of an isostatic press. The pressure is raised during 3 minutes from 0 to 1250 kg/sq.cm., kept at this value for 1 minute and then reduced again.

The pressed and worked blanks are sintered in an electric furnace, where the temperature is raised during 80 hours from room temperature to 1000° C., then increased during ten hours from 1000° to 1250° C., left at this value for 30 hours and then reduced again.

The sintered oxide-ceramic rods have a square end area with an edge length of 3.4 cm. and a length of 24 cm. These rods are assembled as bundles so that a square is produced having three rods for each edge, the interspace between the rods amounting to 2–3 mm.

The rows of three are drilled through parallel with the end faces in one direction, at about 3 cm. away from the upper end faces, with a diamond drill of approximately 1.2 cm. diameter along the side faces lying one upon the other. Then a notching of half-round cross-section with a diameter of about 1.2 cm. is produced on two opposite side faces of each rod. Four rods of approximately 1 cm. diameter and 13 cm. length consisting of highly refractory chromium-nickel steel are used as suspension rods and utilized, as represented in the drawing, for the securing of the individual elements of rod form. The application pressure of the current supply conductor is adjusted to 0.24 MPa.

The bundle electrode is dipped into a carbon tank and heated to 1000° C. during 50 hours. Then cryolite with 3.75% $AlF_3$, 5% $CaF_2$ and 6.9% $Al_2O_3$ is added and melted until the immersion depth of the anodes amounts to about 2 cm. The interpolar distance from the anodes to the liquid aluminum used as cathode and lying on the bottom of the cell amounts to 6–8 cm. The anodic current intensity is increased by stages until it amounts to 1.25 A/sq.cm. After 190 hours of work at this current intensity the anode bundle is withdrawn. The individual elements of rod form after cooling display no damage and are free from cracks.

EXAMPLE 2

40 kg. of tin oxide ($SnO_2$) with a purity of above 99.9% and a mean particle size of less than 5 microns are mixed with 0.8 kg. of copper oxide (CuO) and 0.4 kg. of antimony oxide ($Sb_2O_3$). The material is charged into a latex rubber mould of parallelepipedic form and put into the pressure chamber of an isostatic press. During 3 minutes the pressure is increased from 0 to 1250 kg/sq.cm., kept for one minute at this value and then reduced again.

The pressed and worked blanks are sintered in an electric furnace, the temperature being increased during 80 hours from room temperature to 1250° C., left at this value for 24 hours and then lowered to 150° C. during 48 hours.

The sintered oxide-ceramic rods of square end face have an edge length of 5.0 cm. and a length of 24 cm. Nine rods are assembled as in Example 1 into a bundle anode, producing an effective anode area of 225 sq.cm.

In an electrolysis arrangement corresponding to Example 1 the bundle anode is used with an anodic current intensity of 1.20 A/sq.cm. for 216 hours. At the end of the electrolysis the total anode erosion amounts to 14.6 cc., which corresponds to a mean erosion of 3 microns/-hour, in relation to the bottom area. This corrosion however occurs mainly on the corners of the bundle, while three of the four middle anode rods display no erosion of any kind.

Comparative experiments have shown that the inherently already slight erosion of individual oxide-ceramic anodes of large format can be further reduced in that they are formed as bundle anodes with equal working area. The directed withdrawal of anode gas permits of reducing the anode corrosion of bundles by about a factor 5. This constitutes a further advantage in addition to the simpler ceramic production and the improved stability to temperature change.

The experiments have further shown that with an increase of the number of the anode rods contained in the bundle the reduction of corrosion can be improved still further, because the number of enclosed anodes is increased.

What is claimed is:

1. Anode of a fusion electrolysis furnace for the production of aluminum, comprising a plurality of freely suspended individual oxide-ceramic elements of stable dimensions spaced from each other having a current exit surface and a current entry surface, wherein the individual elements have a linear cross-sectional dimension of 2–12 cm. at said current exit surface and have a length which corresponds to 2–20 times the value of the mean linear cross-sectional dimension, wherein said elements are arranged approximately parallel with a mean distance between outer surfaces of 1–20 mm., and are held together mechanically stably at the end facing the current entry with an electrically conductive supporting device situated outside the molten electrolyte wherein said electrically conductive supporting device is a presser plate electrically conductively connected with a supply conductor.

2. Anode according to claim 1 wherein the individual elements have linear cross-sectional dimensions of 3–10 cm., a length corresponding to 3–10 times the value of the mean linear cross-sectional dimension and a mean distance between outer surfaces of 2–5 mm.

3. Anode according to claim 1 wherein the individual elements are cylindrical or prismatic.

4. Anode according to claim 1, said plate being pressed with 0.05–1.0 MPa upon the upper ends of the ceramic elements.

5. Anode according to claim 4 wherein between the end faces of the ceramic elements and the presser plate an intermediate layer is arranged which consists of at least one layer of metal wire mesh.

6. Anode according to claim 5 wherein said mesh is bright or oxidized nickel.

7. Anode according to claim 4 wherein between the end faces of the ceramic elements and the presser plate an intermediate layer of a metallic ceramic composition is provided.

8. Anode according to claim 4 wherein between the end faces of the ceramic elements and the presser plate an intermediate layer of good conductivity is provided.

9. Anode according to claim 1 wherein the individual elements are selected from the group consisting of at least one oxide of the metals Cr, Mo, W, Mn, Fe, Co, Ni, Zn, Sn and Pb.

10. Anode according to claim 9 wherein the ceramic elements contain in addition less than 10 % of at least one oxide of metals selected from the group consisting of rare earths, Ti, Zr, Hr, V, Nb, Ta, Mg, Ca, Sr, Ba, Al, Ga, Si, Ge, As, Sb, Cu and Bi.

11. Anode according to claim 1 wherein said elements have a length of 4–40 cm.

12. Anode according to claim 1 including a suspension rod supporting said elements at the end facing the current entry.

13. Anode according to claim 12 wherein said suspension rod penetrates said elements and is mounted on a carrier plate.

14. Anode according to claim 13 including means for adjusting said carrier plate.

15. Anode according to claim 1 wherein said elements are rigidly held together in a bundle adjacent the current entry end.

16. Anode according to claim 1 wherein said electrically conductive supporting device is a presser plate pressed upon the upper ends of the ceramic elements and electrically conductively connected with a supply conductor, said anode including a suspension rod supporting said elements at the end facing the current entry.

* * * * *

UNITED STATES PATENT AND TRADEMARK OFFICE

CERTIFICATE OF CORRECTION

PATENT NO. : 4,357,226

DATED : November 2, 1982

INVENTOR(S) : Hanspeter Alder et al.

It is certified that error appears in the above-identified patent and that said Letters Patent are hereby corrected as shown below:

On the Cover Page, the Inventors should be listed as follows:

--[75] Inventors: Hanspeter Alder, Flurlingen; Helmut Tannenberger, Le Château de St. Croix, both of Switzerland--.

In Column 7, claim 10, line 4, change "Hr" to --Hf--.

Signed and Sealed this

*Fifteenth* Day of *February 1983*

[SEAL]

*Attest:*

GERALD J. MOSSINGHOFF

*Attesting Officer*

*Commissioner of Patents and Trademarks*